US008002080B1

(12) United States Patent
Bingham

(10) Patent No.: US 8,002,080 B1
(45) Date of Patent: Aug. 23, 2011

(54) REMOVABLE EXHAUST BAFFLE

(76) Inventor: Charles Bingham, Lighthouse Point, FL (US)

( * ) Notice: Subject to any disclaimer, the term of this patent is extended or adjusted under 35 U.S.C. 154(b) by 0 days.

(21) Appl. No.: 12/660,874

(22) Filed: Mar. 5, 2010

(51) Int. Cl.
*F01N 1/08* (2006.01)

(52) U.S. Cl. ..... 181/241; 181/243; 181/270; 181/278

(58) Field of Classification Search ..... 181/241, 181/243, 264, 270, 271, 277, 278, 279, 280, 181/281; 60/312, 322, 324
See application file for complete search history.

(56) References Cited

U.S. PATENT DOCUMENTS

| | | | | |
|---|---|---|---|---|
| 1,496,509 | A * | 6/1924 | Abell et al. | 181/280 |
| 2,492,784 | A | 12/1949 | Christman | |
| 3,969,895 | A * | 7/1976 | Krizman | 60/312 |
| 4,699,244 | A | 10/1987 | Bergquist | |
| 4,966,253 | A * | 10/1990 | Stephens et al. | 181/227 |
| 5,434,374 | A * | 7/1995 | Hsueh | 181/228 |
| 5,722,237 | A * | 3/1998 | Iida et al. | 60/302 |
| 5,881,555 | A * | 3/1999 | Jaeger | 60/310 |
| 6,367,580 | B1 | 4/2002 | Chang | |
| 6,799,423 | B2 * | 10/2004 | Piekarski | 60/313 |
| 6,848,252 | B2 * | 2/2005 | Maybeck | 60/312 |
| 7,104,359 | B1 * | 9/2006 | Zelinski | 181/264 |
| 7,234,297 | B2 | 6/2007 | Maybeck | |
| 7,451,854 | B2 | 11/2008 | Suzuki | |
| 7,510,046 | B2 * | 3/2009 | Doty | 181/135 |
| 7,510,051 | B2 | 3/2009 | Schrandt | |
| 2004/0084247 | A1 * | 5/2004 | Kishida | 181/227 |
| 2004/0108162 | A1 | 6/2004 | Couvrette | |
| 2004/0238273 | A1 | 12/2004 | Fritskey et al. | |
| 2005/0252712 | A1 * | 11/2005 | Gau et al. | 181/224 |
| 2005/0274568 | A1 * | 12/2005 | Falco et al. | 181/135 |
| 2006/0124384 | A1 | 6/2006 | Tary | |
| 2007/0107981 | A1 | 5/2007 | Sicotte | |
| 2008/0035419 | A1 * | 2/2008 | Moore | 181/212 |
| 2009/0283358 | A1 * | 11/2009 | Hughey | 181/264 |

* cited by examiner

*Primary Examiner* — Elvin G Enad
*Assistant Examiner* — Jeremy Luks
(74) *Attorney, Agent, or Firm* — J. Wiley Horton

(57) ABSTRACT

A selectively removable exhaust baffle which can be placed within an exhaust pipe to muffle the emitted sound. The removable baffle preferably includes a frame having a pair of legs joined by a spring portion. One or more transverse occluding plates are mounted on the frame. The frame is sized so that when it is pushed into the exhaust pipe it must be compressed. This compression holds the frame in place. The transverse occluding plate or plates lie against the interior wall of the exhaust pipe. The gas flow must therefore pass around the plate or plates, thereby attenuating the sound.

20 Claims, 5 Drawing Sheets

REMOVABLE EXHAUST BAFFLE

BACKGROUND OF THE INVENTION

1. Field of the Invention

The present invention relates generally to sound attenuation. More specifically, the present invention comprises an exhaust baffle which may be selectively placed in an exhaust pipe to reduce emitted exhaust sounds when desired.

2. Description of the Related Art

The present invention is particularly suited for use in motorcycle exhausts, and the embodiments disclosed in detail will use motorcycle exhausts as the example. However, the reader should bear in mind that the invention is by no means limited to this application and may be more broadly applied to any scenario in which noise reduction or an increase in back flow pressure is desired.

Motorcycles traditionally have fairly simple exhaust systems. This is particularly true for "V-Twin" engines such as those produced by HARLEY-DAVIDSON. Such exhausts typically provide fairly low sound attenuation. The result is a loud and "thunderous" exhaust tone that many motorcycle enthusiasts find desirable. The loud exhaust noise is in fact a signature effect of this type of motorcycle.

Unfortunately for those desiring the traditional exhaust sound effects, many municipalities have passed noise ordinances defining a maximum sound level permitted for operation of a moving vehicle. Many motorcycles exceed this sound level and may therefore not be legally operated within the particular municipality. The ordinances are not uniform, however. Thus, a motorcycle may be legally operated in many areas yet prohibited from a few areas which have enacted more strict noise ordinances.

One solution is of course to add a muffling device to reduce the exhaust noise so that it complies with the most restrictive noise ordinance. This would require significant sound attenuation. Most motorcycle owners would prefer to have the loud sound available wherever it is legal, and apply the reduced sound only when required. One can of course change exhaust systems, but this is cumbersome. One can also equip the exhaust with complex dual pathways selected by a butterfly valve (as is done in some automotive applications). Such mechanisms add to the weight and complexity of a motorcycle, and additionally tend to spoil the "clean" appearance most motorcycle enthusiasts desire. Thus, it would be preferable to provide a noise attenuating device which could be selectively added to an existing exhaust system without requiring significant modifications. The present invention proposes just such a design.

BRIEF SUMMARY OF THE INVENTION

The present invention comprises a selectively removable exhaust baffle which can be placed within an exhaust pipe to muffle the emitted sound. The removable baffle preferably includes a frame having a pair of legs joined by a spring portion. One or more transverse occluding plates are mounted on the frame. The frame is sized so that when it is pushed into the exhaust pipe it must be compressed. This compression holds the frame in place. The transverse occluding plate or plates lie against the interior wall of the exhaust pipe in an orientation which is preferably perpendicular to the direction of gas flow through the exhaust pipe. The gas flow must therefore pass around the plate or plates, thereby attenuating the sound.

A handle is preferably provided. This extends out the rear of the exhaust pipe to facilitate removal of the baffle. A locking feature is preferably also provided to securely hold the baffle in position until removal is desired. The baffle may be constructed in a variety of ways, with the preferred embodiment being formed by assembling several pieces which may be stored flat when not in use.

REFERENCE NUMERALS IN THE DRAWINGS

| | | | |
|---|---|---|---|
| 10 | removable baffle | 12 | frame |
| 14 | spring portion | 16 | front occlusion plate |
| 18 | middle occlusion plate | 20 | rear occlusion plate |
| 22 | handle | 24 | protrusion |
| 26 | first leg | 28 | second leg |
| 30 | exhaust pipe | 32 | opening |
| 34 | hole | 36 | rear receiver |
| 38 | middle receiver | 40 | front receiver |
| 42 | gas flow | 44 | notch |
| 46 | separate first leg | 48 | separate second leg |
| 50 | spring | 52 | first joint |
| 54 | second joint | 60 | land |

DETAILED DESCRIPTION OF THE INVENTION

Figure 1:
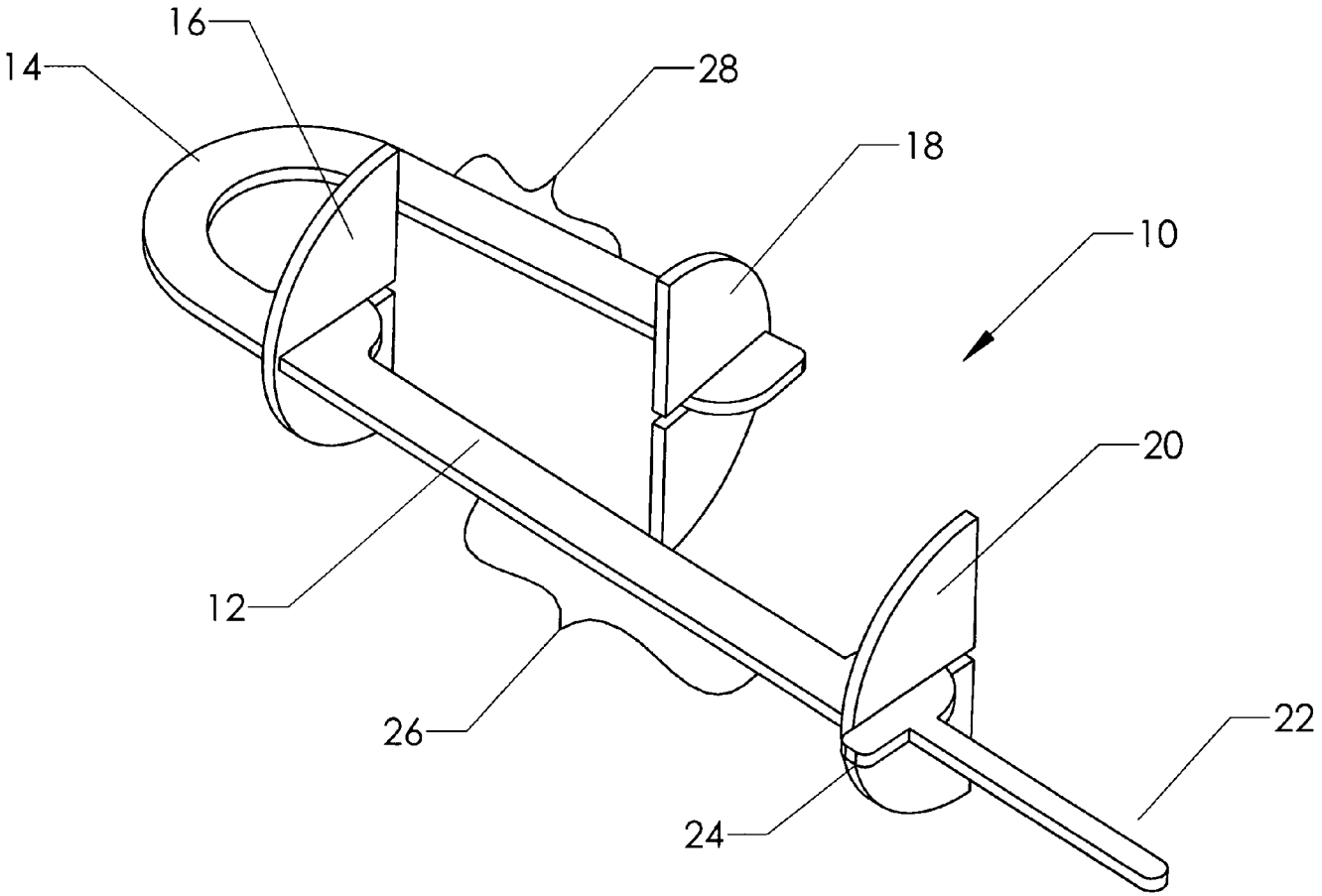
FIG. 1 is a perspective view, showing a preferred embodiment of the removable baffle in an assembled state.

FIG. 1 shows removable baffle 10 in an assembled state. Frame 12 preferably assumes the shape of a V-spring, having first leg 26 and second leg 28 joined by spring portion 14. Those skilled in the art will appreciate that the two legs may be forced toward each other, with spring portion 14 tending to bias the two legs apart.

One or more occlusion plates are provided to impede the flow of exhaust gases when the removable baffle is placed in an exhaust pipe. The number and location of the occlusion plate or plates can be varied to suit a particular application. In the embodiment shown, front occlusion plate 16 and rear occlusion plate 20 are attached to first leg 26. Middle occlusion plate 18 is attached to second leg 28.

The occlusion plates shown in the embodiment of FIG. 1 are half-disks, the diameter of which conforms to the inner diameter of the exhaust pipe. These features allow the circular portion of each occlusion disk to fit securely against the interior of the exhaust pipe. Handle 22 is an extension of the first leg. It is intended to facilitate the removal of the device from an exhaust pipe, as will be described in more detail subsequently.

Figure 2:
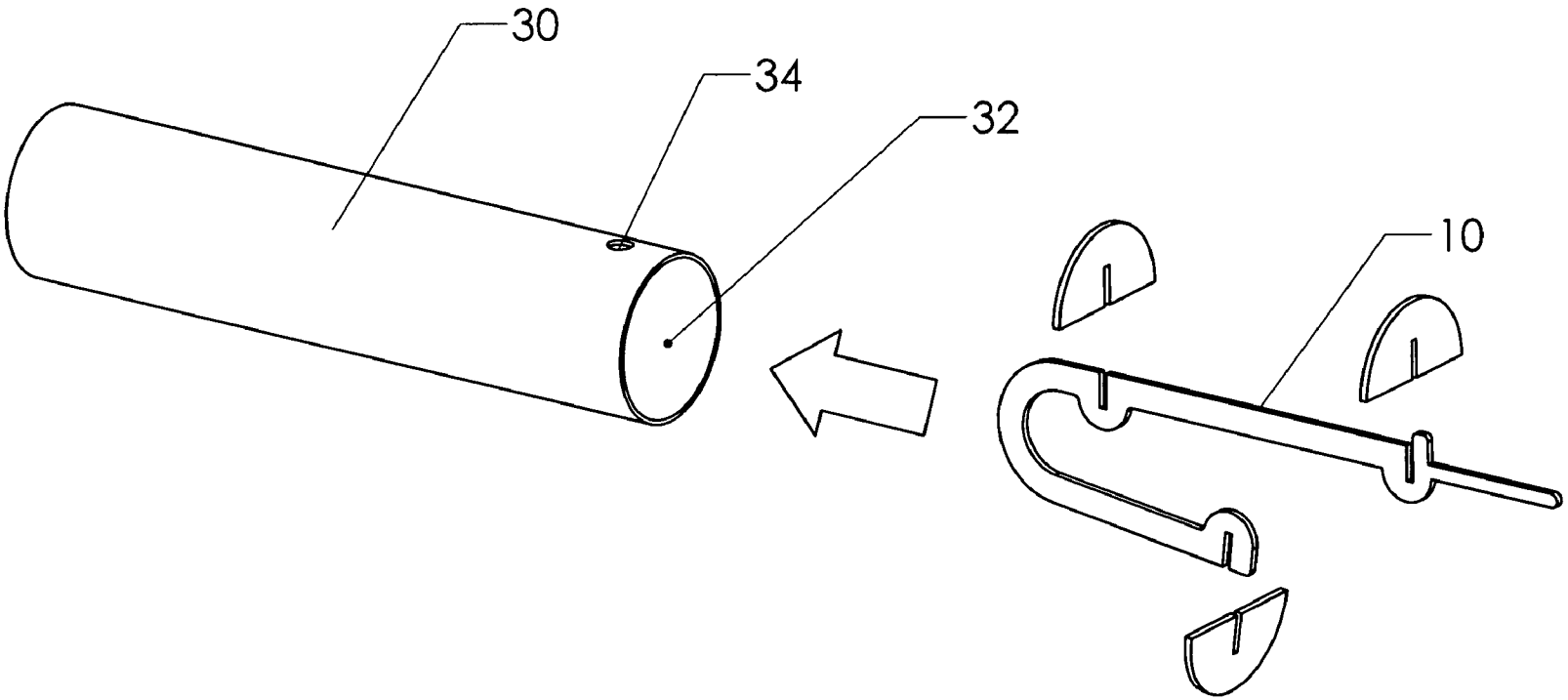
FIG. 2 is a perspective view, showing the removable baffle being inserted into an exhaust pipe.

FIG. 2 shows removable baffle in position and ready to be inserted into a conventional motorcycle exhaust pipe 30. Frame 12 of the removable baffle is preferably sized so that the two legs must be compressed together in order to slide the device into the exhaust pipe. The restoring force of spring portion 14 will then tend to force the two legs outward against the interior of the exhaust pipe—thereby frictionally engaging the surface and retaining the device in position.

Additional features may be optionally added to more securely retain the removable baffle within the exhaust pipe. A mechanical interlocking feature can be provided between the removable baffle and the exhaust pipe. Returning briefly to FIG. 1, an example of this mechanical interlocking feature is provided. Protrusion 24 is provided on first leg 26. Turning back to FIG. 2, the reader will observe the inclusion of a transverse hole 34 in exhaust pipe 30. When the user slides the removable baffle into the exhaust pipe, protrusion 24 snaps into hole 34 and secures the removable baffle in place.

Figure 3:
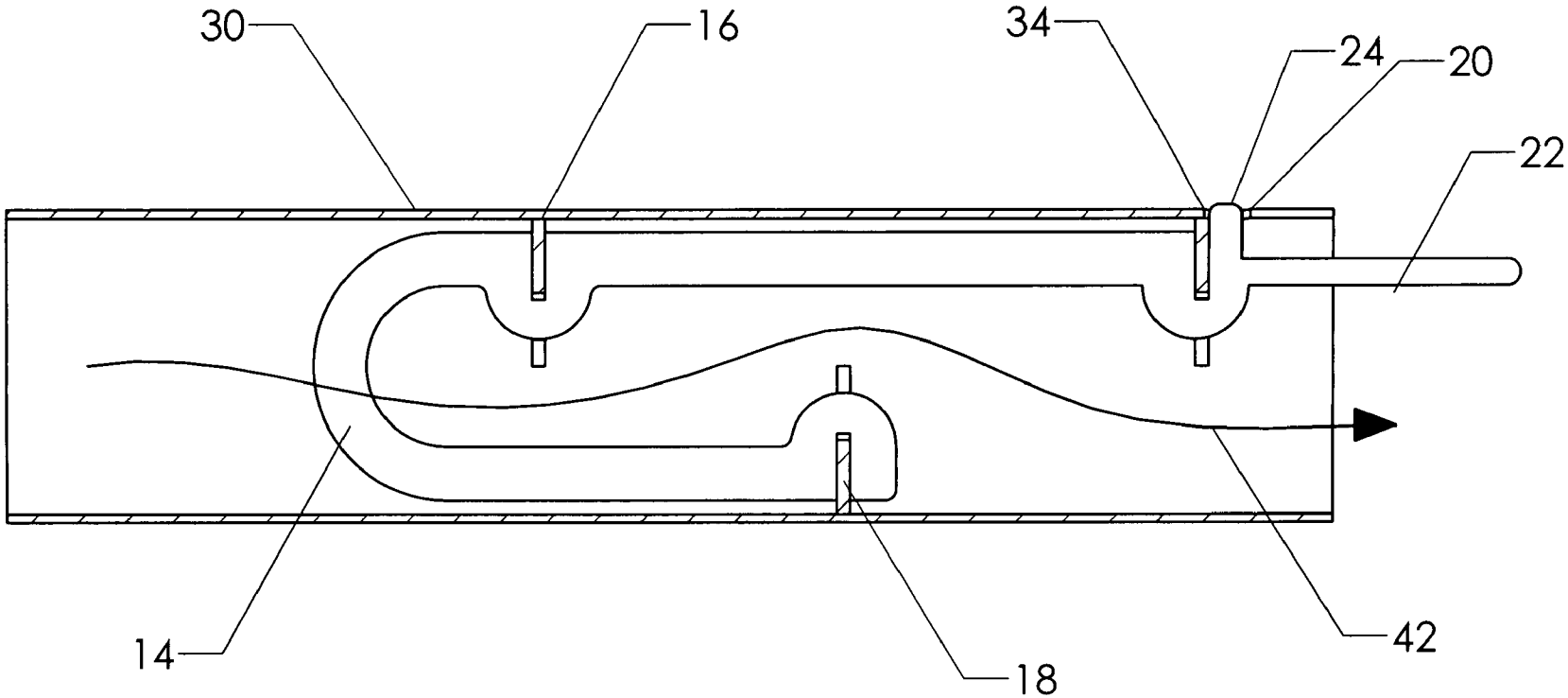
FIG. 3 is a sectional elevation view, showing the removable baffle in position within an exhaust pipe.

FIG. 3 is a sectional elevation view showing the removable baffle in place within an exhaust pipe 30. The reader will note how protrusion 24 is secured within hole 34. This interlocking feature impedes the tendency of the flowing exhaust gases to blow the device out of the exhaust pipe. The embodiment shown uses three evenly spaced occlusion plates (front occlusion plate 16, middle occlusion plate 18, and rear occlusion plate 20). These redirect gas flow 42 through a serpentine path. The effect is substantially reduced exhaust noise.

Handle 22 preferably extends beyond the exit plane of the exhaust pipe to facilitate the removal of the device. In the orientation shown, the user need only press down on the handle to disengage the mechanical interlock. He or she may then slide the removable baffle to the rear and remove it from the tailpipe.

Those skilled in the art will realize that the occlusion plates may assume a virtually infinite variety of forms. They are shown as being perpendicular to the exhaust gas flow but this need not be the case. They may be placed at any suitable angle to the exhaust flow. It is also possible to provide one, two, three, four, five, or more occlusion plates in order to create the desired level of sound attenuation. In some applications it may also be desirable to provide perforated occlusion plates. Simple holes may be provided, or a more complex array of slots or other shapes.

The inventive device will be effective in some applications even though over half of the surface area of each plate is opened by perforations. Many law enforcement agencies test for exhaust attenuation by simply inserting a pointer into the exhaust pipe and feeling for the presence of an obstruction. It is therefore significant that the perforation design used still leave enough solid material to obstruct the passage of such a pointer.

Figure 4:
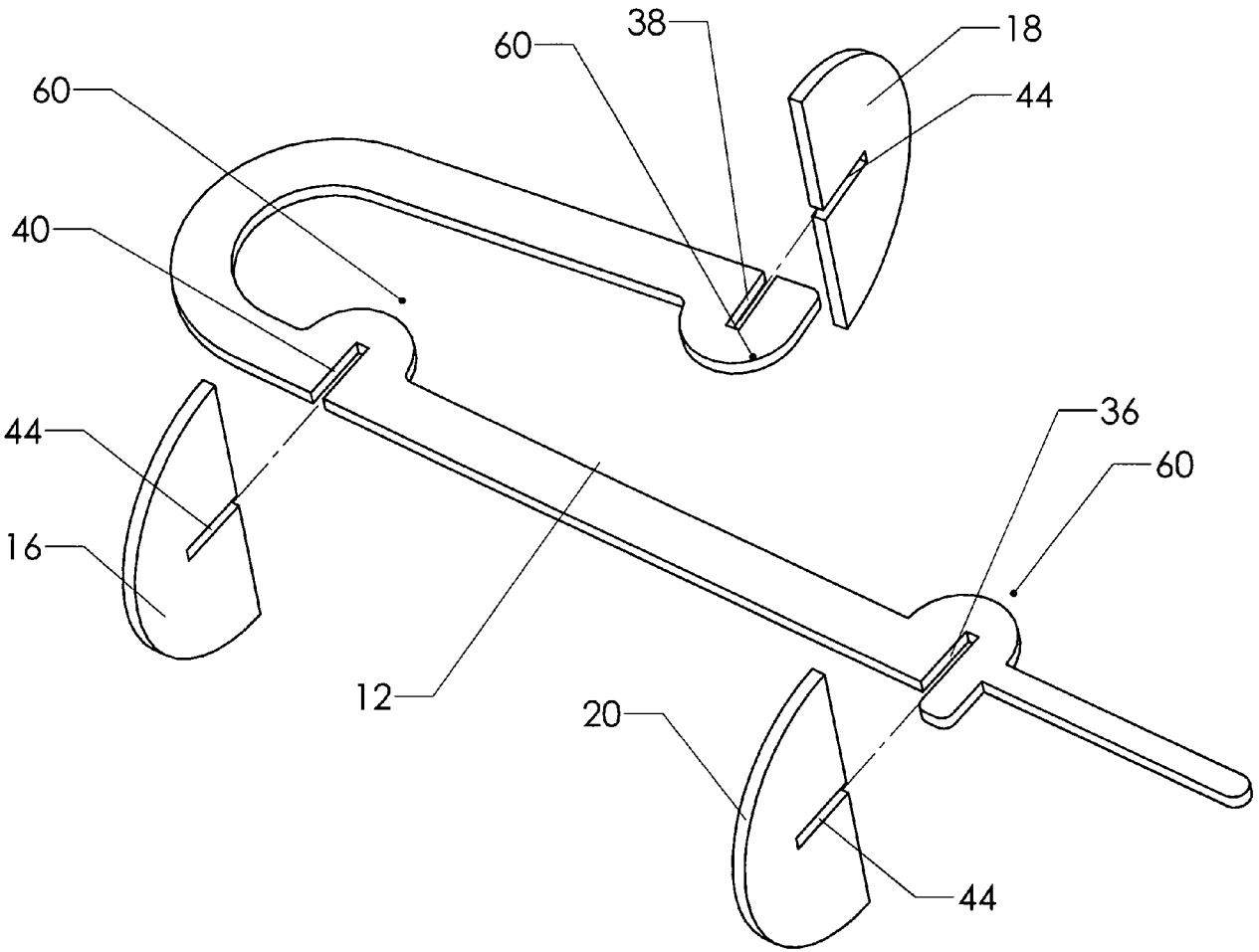
FIG. 4 is an exploded perspective view, showing a preferred embodiment in which the removable baffle is assembled from flat pieces.

FIG. 4 shows an embodiment in which each occlusion plate is made removable from frame 12. As an example, middle occlusion plate 18 is provided with a notch 44 sized to interlock with middle receiver 38 and the accompanying land 60. Front occlusion plate 16 is designed to lock into front receiver 40 and rear occlusion plate 20 is designed to lock into rear receiver 36. In this fashion, a user may select and install one, two, or three occlusion plates without the need for tools or fasteners. When not in use, the entire device may be disassembled and stored in a flat state.

Figure 5:
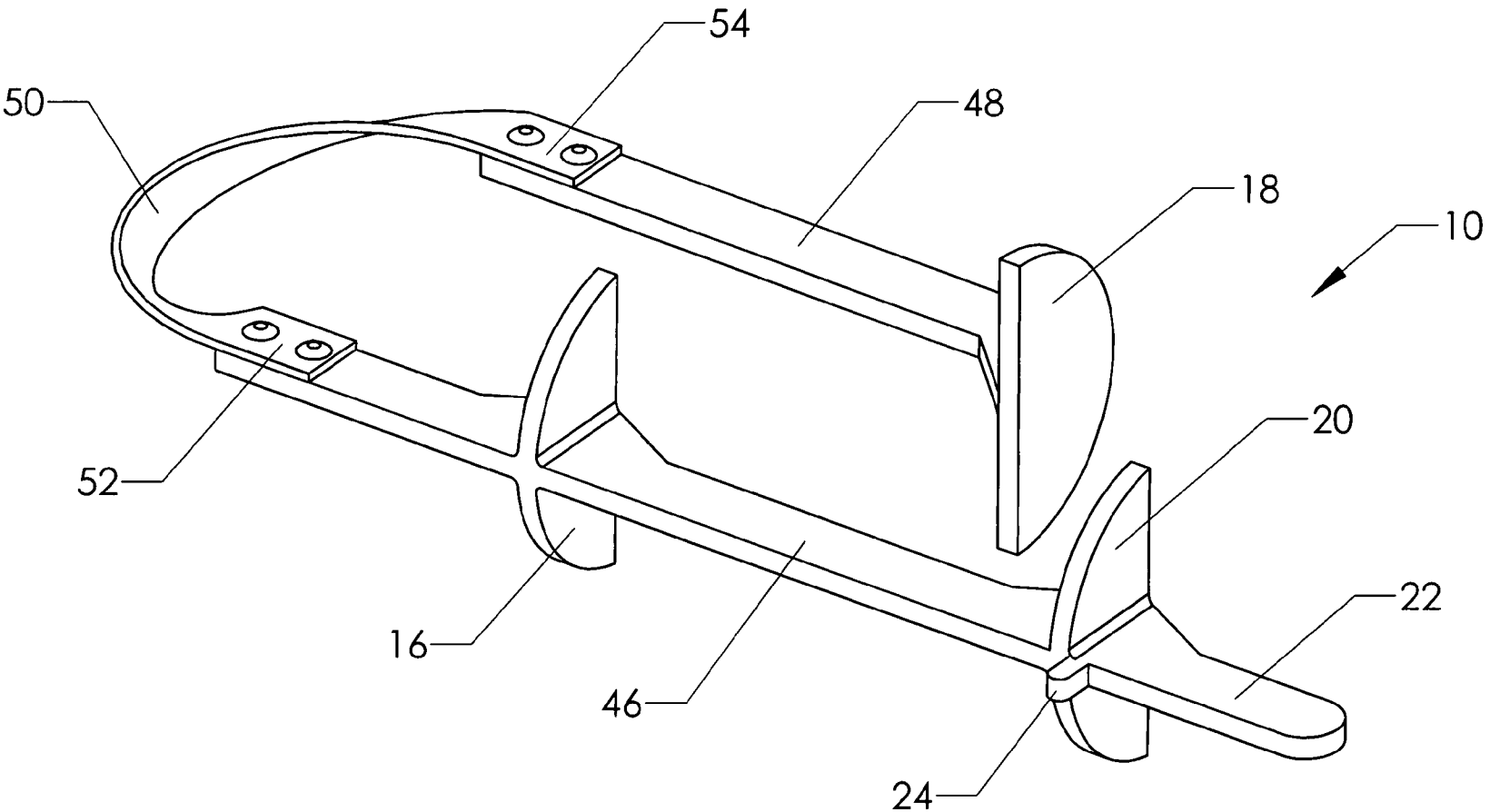
FIG. 5 is a perspective view, showing an embodiment in which a separate spring is used.

FIG. 5 shows a different embodiment having a fixed number of occlusion plates. Separate first leg 46 and separate second leg 48 are forged or cast from a suitable metal with the occlusion plates and other features integrally formed. The two legs are joined by a separate spring 50, which is connected via first joint 52 and second joint 54.

It may be necessary to leave the removable baffle in place for extended periods, during which all the components will be bathed in hot exhaust gases. Thus, heat-resistant metals are the preferred materials—with stainless steel being one good example.

The inventive device and method for its installation are primarily directed toward reducing exhaust noise. However, those skilled in the art will also know that the device can be used to modify exhaust back pressure and to otherwise "tune" the exhaust to produce a desired sound. Thus, the invention should not be viewed as being limited solely to sound attenuation.

The foregoing description and drawings comprise illustrative embodiments of the present invention. Having thus described exemplary embodiments of the present invention, it should be noted by those skilled in the art that the within disclosures are exemplary only, and that various other alternatives, adaptations, and modifications may be made within the scope of the present invention. Many modifications and other embodiments of the invention will come to mind to one skilled in the art to which this invention pertains having the benefit of the teachings presented in the foregoing descriptions and the associated drawings. Although specific terms may be employed herein, they are used in a generic and descriptive sense only and not for purposes of limitation. Accordingly, the present invention is not limited to the specific embodiments illustrated herein, but is limited only by the following claims.

Having described my invention, I claim:

1. A method for selectively attenuating the sound produced by an exhaust pipe having an internal diameter and a central pipe axis, comprising:

a. providing a removable baffle including,
   i. a first leg,
   ii. a second leg,
   iii. a spring portion connecting said first and second legs, said spring portion being configured to urge said second leg pivotally away from said first leg to form a V-spring having a pivot axis,
   iv. an occlusion plate, attached to said first leg, said occlusion plate including a circular portion sized to fit against said internal diameter of said exhaust pipe, and
   v. said V-spring being sized such that said second leg must be compressed toward said first leg in order to slide said removable baffle into said internal diameter;

b. orienting said removable baffle so that said pivot axis is perpendicular to said central pipe axis;

c. compressing said second leg toward said first leg while sliding said removable baffle into said internal diameter; and d. sliding said removable baffle sufficiently far into said exhaust pipe so that said occlusion plate lies within said exhaust pipe and impedes the flow of gas through said exhaust pipe.

2. A method for selectively attenuating the sound produced by an exhaust pipe as recited in claim 1, further comprising:

a. providing a second occlusion plate on said removable baffle, said second occlusion plate including a circular portion sized to fit against said internal diameter of said exhaust pipe, said second occlusion plate being attached to said second leg; and b. sliding said removable baffle sufficiently far into said exhaust pipe so that said first and second occlusion plates both lie within said exhaust pipe and both occlusion plates impede the flow of gas through said exhaust pipe.

3. A method for selectively attenuating the sound produced by an exhaust pipe as recited in claim 2, further comprising:

a. providing a third occlusion plate on said removable baffle, said third occlusion plate including a circular portion sized to fit against said internal diameter of said exhaust pipe, said third occlusion plate being attached to said first leg; and b. sliding said removable baffle sufficiently far into said exhaust pipe so that said first, second, and third occlusion plates all lie within said exhaust pipe and impede the flow of gas through said exhaust pipe.

4. A method for selectively attenuating the sound produced by an exhaust pipe as recited in claim 1, further comprising providing said removable baffle with a handle which protrudes beyond said exhaust pipe when said removable baffle is installed in said exhaust pipe.

5. A method for selectively attenuating the sound produced by an exhaust pipe as recited in claim 1, further comprising:

a. providing a mechanical interlocking feature between said exhaust pipe and said removable baffle, wherein said mechanical interlocking feature fixes said removable baffle in position so that it cannot slide further into or out of said exhaust pipe; and b. engaging said mechanical interlocking feature to secure said removable baffle in position within said exhaust pipe.

6. A method for selectively attenuating the sound produced by an exhaust pipe as recited in claim 5, wherein said mechanical interlocking feature comprises a protrusion on said removable baffle positioned to snap into a transverse hole in said exhaust pipe.

7. A method for selectively attenuating the sound produced by an exhaust pipe as recited in claim 1, further comprising providing an occlusion plate which is removable so that said occlusion plate may be disassembled from said first and second legs.

8. A method for selectively attenuating the sound produced by an exhaust pipe as recited in claim 2, further comprising providing a first and second occlusion plates which are removable so that said occlusion plates may be disassembled from said first and second legs.

9. A method for selectively attenuating the sound produced by an exhaust pipe as recited in claim 3, further comprising providing a first, second, and third occlusion plates which are removable so that said occlusion plates may be disassembled from said first and second legs.

10. A method for selectively attenuating the sound produced by an exhaust pipe having an internal diameter and a central pipe axis, comprising:

a. providing a removable baffle including, i. a first occlusion plate attached to a first leg, ii. a second occlusion plate attached to a second leg, iii. a spring connecting said first and second legs, said spring being configured to urge said first and second legs pivotally away from each other to form a V-spring having a pivot axis, and iv. said removable baffle being sized such that said V-spring must be compressed in order to slide said first and second occlusion plates into said internal diameter;

b. orienting said removable baffle so that said pivot axis is perpendicular to said central pipe axis;

c. compressing said second occlusion plate toward said first occlusion plate while sliding said removable baffle into said internal diameter; and d. sliding said removable baffle sufficiently far into said exhaust pipe so that said first and second occlusion plates lie within said exhaust pipe and impede the flow of gas through said exhaust pipe.

11. A method for selectively attenuating the sound produced by an exhaust pipe as recited in claim 10, further comprising:

a. providing a third occlusion plate on said removable baffle; and b. sliding said removable baffle sufficiently far into said exhaust pipe so that said first, second, and third occlusion plates all lie within said exhaust pipe and impede the flow of gas through said exhaust pipe.

12. A method for selectively attenuating the sound produced by an exhaust pipe as recited in claim 10, further comprising providing said removable baffle with a handle which protrudes beyond said exhaust pipe when said removable baffle is installed in said exhaust pipe.

13. A method for selectively attenuating the sound produced by an exhaust pipe as recited in claim 10, further comprising:

a. providing a mechanical interlocking feature between said exhaust pipe and said removable baffle, wherein said mechanical interlocking feature fixes said removable baffle in position so that it cannot slide further into or out of said exhaust pipe; and b. engaging said mechanical interlocking feature to secure said removable baffle in position within said exhaust pipe.

14. A method for selectively attenuating the sound produced by an exhaust pipe as recited in claim 13, wherein said mechanical interlocking feature comprises a protrusion on said removable baffle positioned to snap into a transverse hole in said exhaust pipe.

15. A method for selectively attenuating the sound produced by an exhaust pipe as recited in claim 10, further comprising providing occlusion plates which are removable so that said occlusion plates may be disassembled from said removable baffle.

16. A method for selectively attenuating the sound produced by an exhaust pipe as recited in claim 11, further comprising providing occlusion plates which are removable so that said occlusion plates may be disassembled from said removable baffle.

17. A method for selectively attenuating the sound produced by an exhaust pipe as recited in claim 11, further comprising:

a. providing a mechanical interlocking feature between said exhaust pipe and said removable baffle, wherein said mechanical interlocking feature fixes said removable baffle in position so that it cannot slide further into or out of said exhaust pipe; and b. engaging said mechanical interlocking feature to secure said removable baffle in position within said exhaust pipe.

18. A method for selectively attenuating the sound produced by an exhaust pipe as recited in claim 12, further comprising:

a. providing a mechanical interlocking feature between said exhaust pipe and said removable baffle, wherein said mechanical interlocking feature fixes said removable baffle in position so that it cannot slide further into or out of said exhaust pipe; and b. engaging said mechanical interlocking feature to secure said removable baffle in position within said exhaust pipe.

19. A method for selectively attenuating the sound produced by an exhaust pipe as recited in claim 4, further comprising:

a. providing a mechanical interlocking feature between said exhaust pipe and said removable baffle, wherein said mechanical interlocking feature fixes said removable baffle in position so that it cannot slide further into or out of said exhaust pipe; and b. engaging said mechanical interlocking feature to secure said removable baffle in position within said exhaust pipe.

20. A method for selectively attenuating the sound produced by an exhaust pipe as recited claim 10 further comprising providing said occlusion plates which are selectively removable from said legs.

* * * * *